US009145719B2

(12) United States Patent
Hartford

(10) Patent No.: US 9,145,719 B2
(45) Date of Patent: Sep. 29, 2015

(54) APPARATUS FOR A DOOR LATCH

(75) Inventor: Wayne Hartford, Santa Clarita, CA (US)

(73) Assignee: MILOCON INC., Santa Clarita, CA (US)

( * ) Notice: Subject to any disclaimer, the term of this patent is extended or adjusted under 35 U.S.C. 154(b) by 485 days.

(21) Appl. No.: 13/604,598

(22) Filed: Sep. 5, 2012

(65) Prior Publication Data

US 2014/0361552 A1 Dec. 11, 2014

Related U.S. Application Data

(60) Provisional application No. 61/531,084, filed on Sep. 5, 2011, provisional application No. 61/602,588, filed on Feb. 23, 2012.

(51) Int. Cl.

| | |
|---|---|
| ***E05C 1/12*** | (2006.01) |
| ***E05C 1/02*** | (2006.01) |
| ***E05C 1/14*** | (2006.01) |
| ***E05B 1/00*** | (2006.01) |
| *E05B 17/22* | (2006.01) |
| *E05B 65/00* | (2006.01) |
| *E05B 17/00* | (2006.01) |

(52) U.S. Cl.

CPC ..... *E05C 1/02* (2013.01); *E05B 1/0038* (2013.01); *E05C 1/14* (2013.01); *E05B 17/007* (2013.01); *E05B 17/22* (2013.01); *E05B 65/0035* (2013.01); *Y10T 292/0969* (2015.04)

(58) Field of Classification Search

CPC ..... E05B 1/0038; E05B 17/007; E05B 3/003; E05B 3/04; E05B 3/10; E05B 65/0035; E05B 17/22; E05C 1/004; E05C 1/08; E05C 1/12; E05C 1/14; E05C 1/02; Y10T 292/0969

USPC ..... 292/163, 165, 166, 169, 169.18, 170, 292/174, 347, 140, 348, 349, 356, 1.5, 92, 292/252, DIG. 57

See application file for complete search history.

(56) References Cited

U.S. PATENT DOCUMENTS

| | | | | | |
|---|---|---|---|---|---|
| 629,123 | A | * | 7/1899 | Davis | 292/356 |
| 659,887 | A | * | 10/1900 | Crouch | 292/170 |
| 980,630 | A | | 1/1911 | Granger | |

(Continued)

OTHER PUBLICATIONS

U.S. Appl. No. 61/531,084, filed Sep. 5, 2011; inventor: Hartford; title: apparatus for a door latch.

(Continued)

*Primary Examiner* — Kristina Fulton
*Assistant Examiner* — Christine M Mills
(74) *Attorney, Agent, or Firm* — Law Office of David Hong

(57) ABSTRACT

An improved apparatus for a door latch, which enables the user to open the door with a simple pull or push (force) on the door handle, has a door handle, which is removably connected to an actuator, which translates this force to disengage a bolt from the strike plate in the door frame. The bolt has an angled actuator engagement area (AES), which engages a bushing or sliding area on the actuator, such that when said force is applied the actuator, said bushing or sliding area is able to translate said force along the AES and move the bolt from a first position to a second position and to disengage the bolt from the strike plate and to allow the door to be opened. There is also at least one actuator support structure with at least one roller bearing and a roller bearing pin.

16 Claims, 11 Drawing Sheets

(56) References Cited

U.S. PATENT DOCUMENTS

| | | | | | |
|---|---|---|---|---|---|
| 1,021,864 | A | | 2/1912 | Denzler | |
| 2,124,099 | A | * | 7/1938 | Zagrzejewski | 292/170 |
| 2,383,574 | A | | 8/1945 | Voight | |
| 2,547,108 | A | * | 4/1951 | Anderson | 292/170 |
| 2,701,735 | A | * | 2/1955 | Segal | 292/348 |
| 2,939,737 | A | * | 6/1960 | Nygren | 292/170 |
| 3,210,976 | A | | 10/1965 | Best | |
| 3,314,746 | A | * | 4/1967 | Millar | 422/186 |
| 3,385,622 | A | * | 5/1968 | Winger | 292/170 |
| 3,490,803 | A | * | 1/1970 | Rollins | 292/170 |
| 3,582,121 | A | * | 6/1971 | Rollins | 292/170 |
| 3,636,740 | A | * | 1/1972 | Rollins | 70/92 |
| 4,756,178 | A | * | 7/1988 | Shen | 70/380 |
| 5,026,101 | A | * | 6/1991 | Dotterweich et al. | 292/166 |
| 5,156,463 | A | | 10/1992 | Zaguroli | |
| 5,157,953 | A | | 10/1992 | Hung | |
| 5,852,944 | A | | 12/1998 | Collard | |
| 5,947,535 | A | * | 9/1999 | Baker | 292/165 |
| 6,293,598 | B1 | | 9/2001 | Rusiana | |
| 6,926,315 | B2 | * | 8/2005 | Kondratuk | 292/165 |
| 7,607,704 | B2 | * | 10/2009 | Kondratuk | 292/337 |
| 7,871,112 | B2 | | 1/2011 | Kondratuk | |

OTHER PUBLICATIONS

U.S. Appl. No. 61/602,588, filed Feb. 23, 2012; inventor: Hartford; title: improvements for apparatus for a door latch.

U.S. Appl. No. 12/418,610, filed Apr. 5, 2009, inventor: Hartford; title: apparatus for securing cupboards and drawers during an earthquake or other seismic events and for child-safety.

PCT Patent Appl. No. PCT/US2010/029883; filed Apr. 3, 2010, inventor: Hartford; title: apparatus for securing cupboards and drawers during an earthquake or other seismic events and for child-safety.

U.S. Appl. No. 61/645,015, filed May 9, 2012, inventor: Hartford; title: apparatus for securing cupboards and drawers during an earthquake or other seismic events and for child-safety.

PCT Patent Appl. No. PCT/US12/53812; filed Sep. 5, 2012; inventor: Hartford; title: improvements for apparatus for a door latch.

* cited by examiner

APPARATUS FOR A DOOR LATCH

RELATED APPLICATIONS

This application claims the benefit of U.S. Provisional Patent Application No. 61/531,084, filed Sep. 5, 2011 and U.S. Provisional Patent Application No. 61/602,588, filed Feb. 23, 2012, which are incorporated by reference in entirety.

BACKGROUND OF THE INVENTION

1. Field of the Invention

This invention relates to improvements for an apparatus for a door latch.

2. Description of Related Art

Prior to the present invention, most door latches required the user to twist and rotate a door knob or handle around an axis. Existing Push-Pull type door mechanisms typically require a separate device such as mount with paddles to actuate the mechanism. These paddles can only be oriented in one specific direction at a time and force the user to position their hand to match the orientation of the paddle or handle to open the door.

In all spring loaded push-pull designs, the act of pushing or pulling to release the door causes friction between the sliding surfaces in the mechanism including between the bolt and strike plate. As the mechanism is actuated, the spring force increases, which in turn increases friction within the mechanism and bolt and strike plate, so that the user has to apply continually increasing force until the bolt releases from the strike plate.

Current designs are complex mechanisms that take more force to operate due to the number of sliding surfaces and the additional pivot located within the separate paddle/handle mechanism.

Some disadvantages of the design reflected in U.S. Pat. No. 7,607,704: the mechanism starts off with a mechanical disadvantage meaning more force is spent pushing on the door, which increases friction between the bolt and strike plate than is spent drawing the bolt back to release the door. In the design as shown, forces that are exerted by the user beyond the limit of travel of the mechanism create a moment on the screws that mount the bolt housing to the door.

From the preceding descriptions, it is apparent that the devices currently being used have significant disadvantages. Thus, important aspects of the technology used in the field of invention remain amenable to useful refinement.

SUMMARY OF THE INVENTION

In accordance with the invention, one of the purposes of this invention is to provide a simple and convenient solution for opening a door latch with a simple push or pull of the handle; the door handle, which is connected to the actuator, which translates this pushing or pulling force to move a bolt assembly from engaging the strike plate in the door frame.

An apparatus for a handle for a door and a door frame and a strike plate on said door frame comprising: a bolt assembly having a bolt and a spring; said spring with a first spring end and a second spring end; the first spring end engages the bolt; the second spring end is connected to the bolt housing; said spring applies a resistant force against said bolt; the bolt having a first bolt end and a second bolt end; the first bolt end being able to engage the strike plate so that the apparatus engages the door and so that the door is closed; the second bolt end having an angled (or curved) engagement surface; an actuator has a first actuator end and a second actuator end; an actuator bushing and a bushing axle lies between said first and the second actuator ends; the actuator is oriented to said bolt so that the actuator bushing is able to roll along the angled engagement surface of the bolt, such that when a force (pushing or pulling) is applied to the first actuator end, said actuator bushing is able to translate said force along the angled engagement surface and move the bolt from a first position to a second position, which disengages the first bolt end from the strike plate and the door can be opened; a pair of actuator support structures surround the first and second actuator ends; each actuator support structure has a central opening, which accommodates the actuator; on an edge of the opening of each actuator support structures, there is at least one roller bearing and at least one roller bearing pin (typically, at least 2 or more per side of the actuator inner support surface); whereby when the force is applied to the first actuator end; said actuator support structures allow the actuator to move freely within said actuator supports and provides a uniform support around said actuator ends; the pair of actuator support structures can also have at least one guide tube for connecting said pair of actuator supports to one another with a screw, a bolt or a threaded pin.

One of said actuator supports has an alignment guide structure for holding said bolt. One of said actuator supports has a rotatable arm with a first arm end and a second arm end; the first arm end can engage a hole on said actuator in a first locked position; said rotatable arm is swung from a first locked position to a second unlocked position, wherein in the second unlocked position, said first arm end is free from the hole on the actuator and said actuator can move against said bolt. The actuator has a stop structure, which restricts the range of travel of the actuator along one axis length.

A door handle is removably attached to the first and the second actuator ends; the door handle has a first handle end and a second handle end; the second handle end has a release ring, a locking ring with teeth, at least one door handle spring and a mounting piece; whereby the user will rotate the release ring so that the locking ring will rotate against the at least one door handle spring, and the teeth of the locking ring will be able to disengage matching slots on the actuator ends, and the door handle will be able to be detached from the actuator.

The actuator support structures can have a base section, a midlevel section and a cover section; the base section has a matching number of grooves for the at least one roller bearing pin and a base section opening; the midlevel section provides an elevation space to allow the at least one roller bearing to rotate freely about the at least one roller bearing pin; the cover section keeps the base section, the midlevel section, the at least one roller bearing and the at least one roller bearing axle to be contained and with a proper alignment and orientation with respect to the actuator. The apparatus further can have a motion sensor, a light, a battery, a computing device, a wireless communication connection or a speaker.

An improved apparatus for a door latch, which enables the user to open the door with a simple pull or push (force) on the door handle, has a door handle, which is removably connected to an actuator, which translates this force to disengage a bolt assembly (includes a bolt and a spring) from the strike plate in the door frame. The bolt has an angled actuator engagement area (AES), which engages a bushing or a sliding area on the actuator; as the bushing travels along the AES, the curve or angle of the AES compensates for the increased spring pressure (on the bolt assembly) as the spring is deflected within the bolt. As the spring force increases, this apparatus maintains the mechanical advantage. When said force is applied the actuator, said bushing or sliding area is able to translate said force along the AES and move the bolt from a first position to a second position and to disengage the bolt from the strike plate and to allow the door to be opened. There is also at least one actuator support structure with at least one roller bearing and a roller bearing pin.

As shown in the presented invention, the shape of the actuator and corresponding shape of the bearing network are designed to accommodate moments that can be generated by cantilever handles that extend perpendicularly and well beyond the actuator without any significant increase in friction. This allows the design of handles for convenience that do not force the user to position their hand in any specific attitude to operate the mechanism.

The mechanism greatly reduces friction and improves easy of operation by reducing the number of number of moving parts and sliding surfaces (only one) that are apparent or implied in existing designs.

The mechanism starts off with an equal mechanical advantage and because the inclined surface of the actuator engagement surface (AES) on the bolt is angled or curved so that mechanical advantage is maintained as spring force increases. The actuator engages this AES or inclined surface of the bolt via a roller bushing, which eliminates a sliding surface.

The present invention introduces such refinements. In its preferred embodiments, the present invention has several aspects or facets that can be used independently, although they are preferably employed together to optimize their benefits. All of the foregoing operational principles and advantages of the present invention will be more fully appreciated upon consideration of the following detailed description, with reference to the appended drawings.

PARTS LIST

Figure 1:
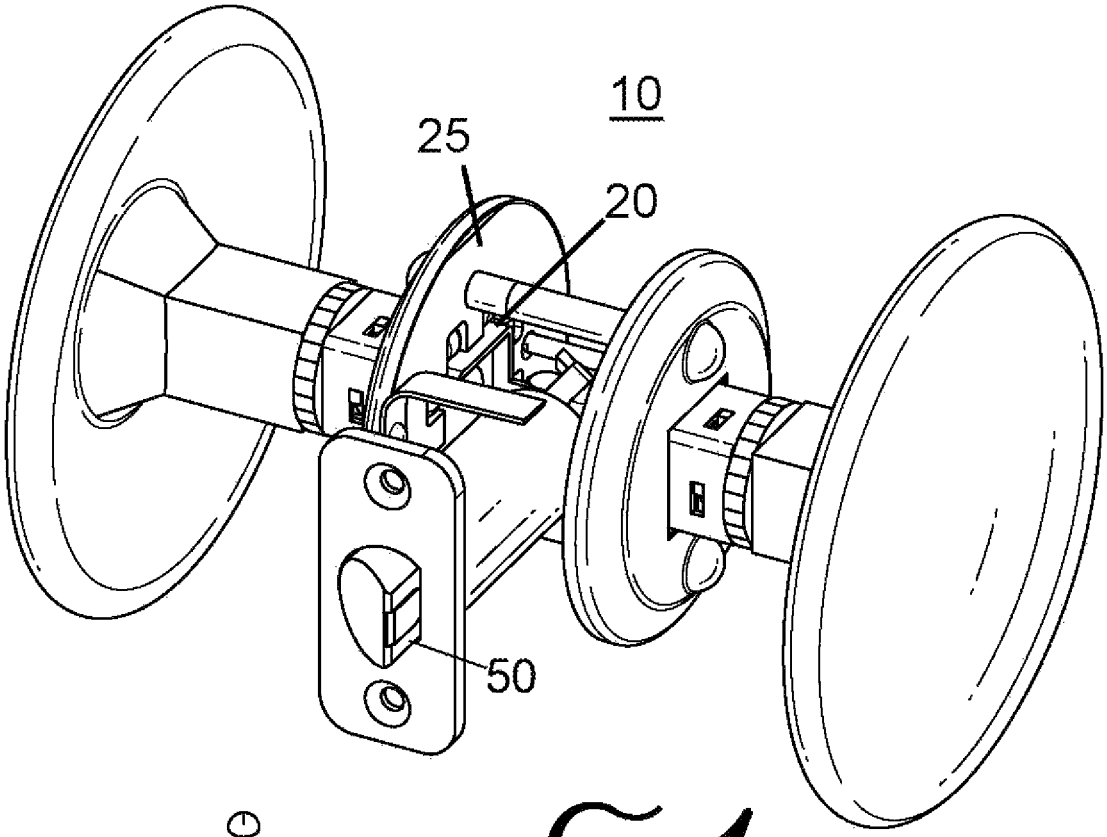
FIG. 1 is a view of one embodiment of the apparatus for a door latch.
Figure 5:
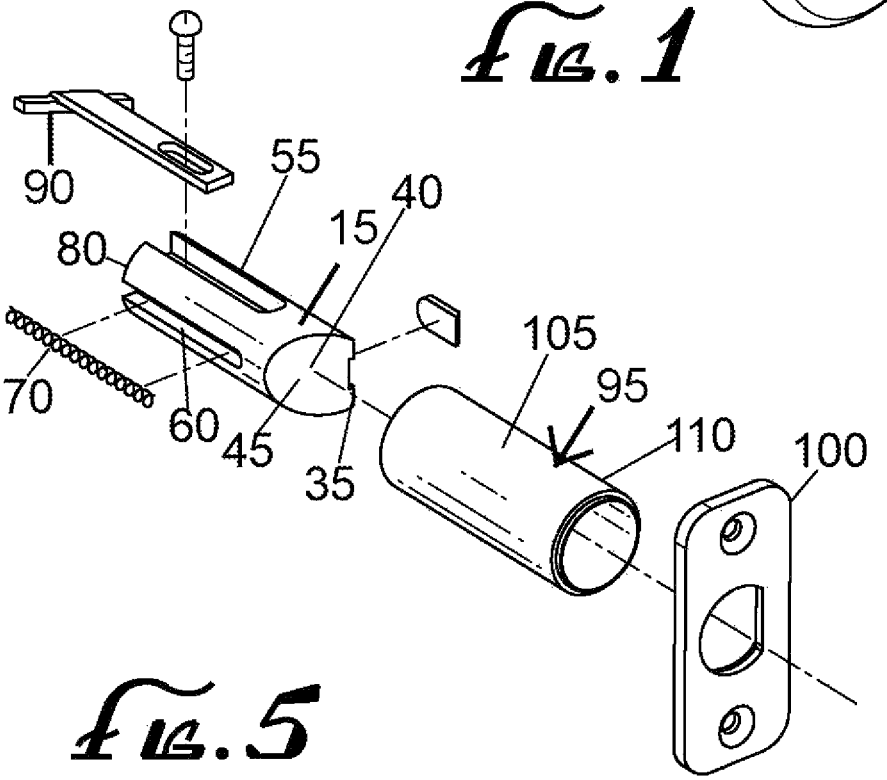
FIG. 5 shows an exploded view of the bolt assembly (AES, bolt and bolt housing).

10-Door Latch Assembly
15-Bolt Assembly (bolt and bolt housing)
20-Actuator
25-Actuator Support
30-Bolt
35-First bolt end
40-Engages the strike plate
45-Slope or ramp end or angled end
50-Shelf side (flat side)
55-Middle of the Bolt
60-cavity for spring, and spring retainer
70-Spring has two looped ends
An extension spring (vs. a compression spring, which is not used here)
spring retainer (not shown)
80-Second bolt end
Cavity for engaging the actuator
One flat surface that is opposite the AES
One flat surface that is adjacent to the AES and second (flat) AES surface
90-Actuator Engagement Surface (A.E.S.)
95-Bolt Housing
100-First BH end—mounting flange
105-Second BH end—support tube or housing for the bolt
110-Support Tube
20-Actuator
115-1st actuator end (push side)
Feature or hole or threaded hole—to accept the door attachment
125-2nd actuator end (pull side)
130-Middle portion of Actuator
sliding portion of actuator that engages the AES
145-Bushing—that engages the AES
150-Bushing pin.
25-Actuator Support
Body
160-Generally central opening
165-Opening is surrounded by four orthogonal sides that each have 2 bushings, 2 bushing axles
Two allows compensation for any potential rotation of the actuator.
The 90 degree located bushings are close together to have continuous smooth function.
170-Bushing axle
172-Bushing Rollers
175-Screw holes or features.
180-Screw guides for attaching screws from first actuator support to second actuator support
Strike plate will have at least one bushing and bushing axle to engage the flat surface on the bolt.
200 U-Shaped Guide for Bolt, located on actuator support surface; bolt alignment guide structure
205 privacy lock
210 privacy lock arm (rotatable)
first end of lock arm
second end of lock arm
engagement hole on actuator
230 stop on actuator
235 Door Handle
240 Door handle attachment assembly
245 first handle end (handle itself)
255 second handle end (engagement area to connect to the inside of the actuator).
260 release ring
266 a locking ring with teeth,
270 teeth on locking ring
275 at least one spring
280 the mounting piece
285 a screw or bolt ridges or a knurled surface for easy gripping for hand use on release ring.

295 door handle electronics, lighting and sound production, motion sensor and a camera and wireless link.

300 base or foundation part of actuator support

305 middle or midlevel section of actuator support

310 cover or top portion of actuator support

315 grooves in base or foundation

320 grooves in cover portion of actuator support

325 corners (in inner surface) in base or foundation of actuator support

330 corners (in inner surface) in middle or midlevel section of actuator support

335 corners in top or cover section of actuator support

DESCRIPTION OF THE PREFERRED EMBODIMENTS

Referring to the attached FIGS. 1-17, there is illustrated an apparatus for a door latch. The most basic parts of this Door Latch Assembly 10: (1) Bolt Assembly 15 (bolt, spring and bolt housing); (2) Actuator 20; and (3) Actuator Support 25.

Bolt Assembly

The bolt assembly has a bolt housing 95 and a bolt 30 and a spring 70 within the bolt.

The bolt has a first bolt end 35, which engages the strike plate 40 (mounted in the door frame); the first bolt end has a sloped, ramp or angled end 45; there is also a flat shelf side 50.

The middle 55 of the bolt has a slot, cavity or channel 60 for a spring and spring retainer. This slot or cavity passes through the body of the bolt for the spring retainer. Other embodiments may allow for multiple spring retainers.

The spring has two looped ends and preferably is an extension type spring. In other embodiments, one can employ springs with a different level of force or resistance to provide a different function (i.e. harder or easier to open). One can also employ compression springs. These different types of springs will create a force with causes the bolt to engage the strike plate and door jamb. The spring is connected at one end to the bolt and to the other end to the bolt housing; the connection to the bolt housing can be through a retaining bolt.

The bolt has a second bolt end 80, which has an area or a cavity for engaging the actuator. On an interior surface of the second bolt end there is an actuator engagement surface (AES) 90. This AES is generally angled or curved to engage the roller bushing 145 on the actuator. This actuator engagement surface 90 is an important part of the invention that engages the roller on one central portion of the actuator (as described below).

In FIG. 1-13, the bolt is comprised of a first bolt piece and a second bolt piece 82, which are connected to one another with a screw or another equivalent attachment means. The first bolt piece is similar to the first bolt end 35, which engages the strike plate. The second bolt piece 82 can be a rod shaped end that has an actuator engagement surface in a hammer or has at least one leg or arm protruding from the rod. This second bolt piece can also have a curved AES or an AES that is a defined angle relative to the length of the bolt. The bolt can have one spring with a first and a second spring end; one spring end is attached to the bolt housing and the other end is attached bolt. The first end of the bolt also can have a pad for reducing friction between the bolt and strike plate.

The bolt moves in a parallel manner to the door face and secures the door to the door jamb. By movement of the bolt, the door can be engage or disengage from the door jamb. Other features of the bolt include: 1. provides a corresponding feature with the actuator that has a form that creates a particular mechanical advantage for disengaging the door jamb when acted upon by the actuator; 2. provides a feature or form with that engages the strike plate in the door jamb to engage or disengage the door jamb when acted upon by the actuator; 3. provides a volume for housing the spring that forces (causes) the bolt to an extended or in the engaged position with the door jamb; and 4. provides a low friction interface between the door and door jamb.

Bolt Housing

The bolt housing 95 has a first bolt housing end 100, which is a mounting flange, which can have several holes for screws. The second bolt housing end 105 is a support tube or column 110. This support tube can also have openings for featuring a spring retainer or spring retainer pin. The bolt will move freely and without restriction within the bolt housing; the spring within the bolt provides elastic resistance.

Actuator

The actuator 20 has a first actuator end (push side) 115 and a second actuator end (pull side) 125. The actuator can have a feature or hole or threaded hole to accept the door adapter or attachment to allow mounting of the door handle. Conceivably, the door handle can be directly attached to the actuator ends.

The middle portion 130 of the actuator has multiple spaces, notches or hollows; in one embodiment, there is a first notch and second notch. These notches or spaces allow for engagement of the actuator with the second end of the bolt. The first notch engages the AES on the bolt; the second notch is needed to allow movement of the bolt along with the actuator. This second notch allows the bolt and actuator to lie on a common plane or elevation.

The actuator also has a roller or bushing 145 that engages the AES on the bolt. There is also a bushing pin or axle 150. The actuator actuates the bolt, and as the user pushes or pulls on the actuator (via the attached door handle), the actuator draws the bolt back so that the first end of the bolt will disengage from the strike plate on the door frame.

As the actuator goes through its motion, the actuator bushing will travel the curved or angled surface of the bolt (AES) and compensates for increased spring pressure as the spring is deflected within the bolt. As the spring force increases, this apparatus maintains the mechanical advantage.

The actuator is a device that moves perpendicularly to the door face and supports the actuator axle and bushing, which provides a low friction interface between itself and the corresponding feature (AES) on the Bolt.

Other features of the actuator include: a. forms a mechanical connection between the two sides of the door. provides a mounting interface for the door handles on both sides of the door; b. with axial (end) force moves perpendicularly to the door face, which causes the bolt to be disengaged (extracted) from the door jamb; c. supports and positions the actuator stop; d. provide a recess that can be engaged by the privacy lock, which restricts actuator movement; e. provides the engagement for supporting and attaching the handles; and f. provides cavities and positions the handling locking mechanism so that the handles can be attached and detached without the use of tools.

Figure 2A:
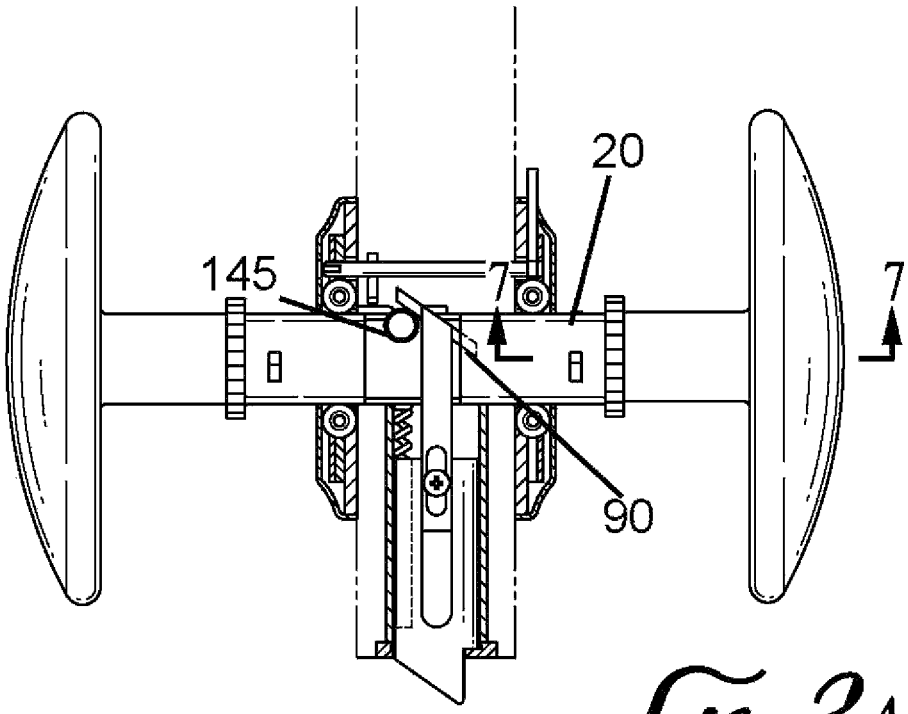
FIG. 2A shows a cross-section view of the apparatus of FIG. 1 in a first closed position.
Figure 2B:
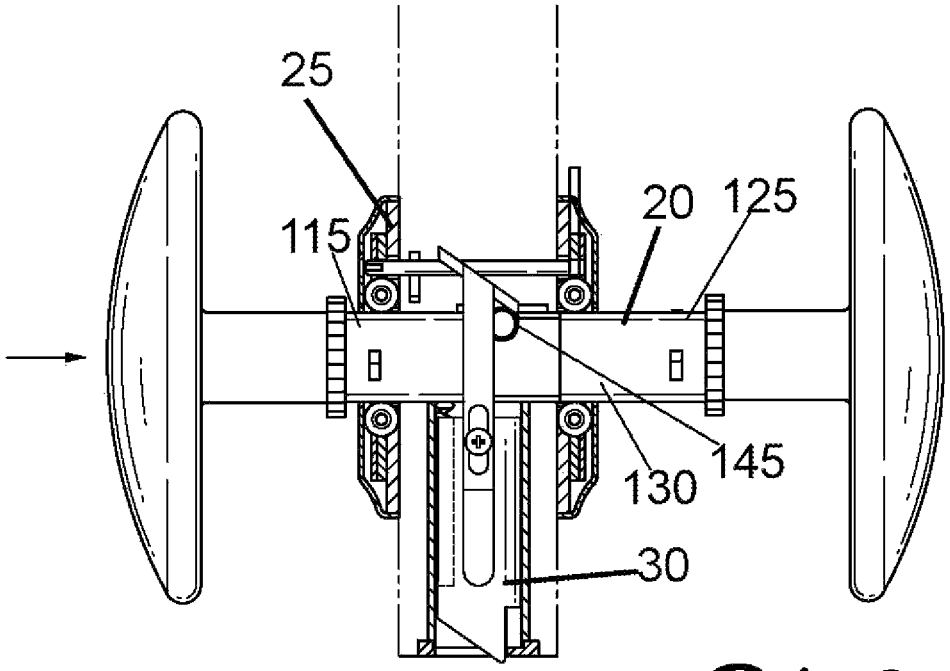
FIG. 2B shows a cross-section view of the apparatus of FIG. 1 in a first opened position.
Figure 3:
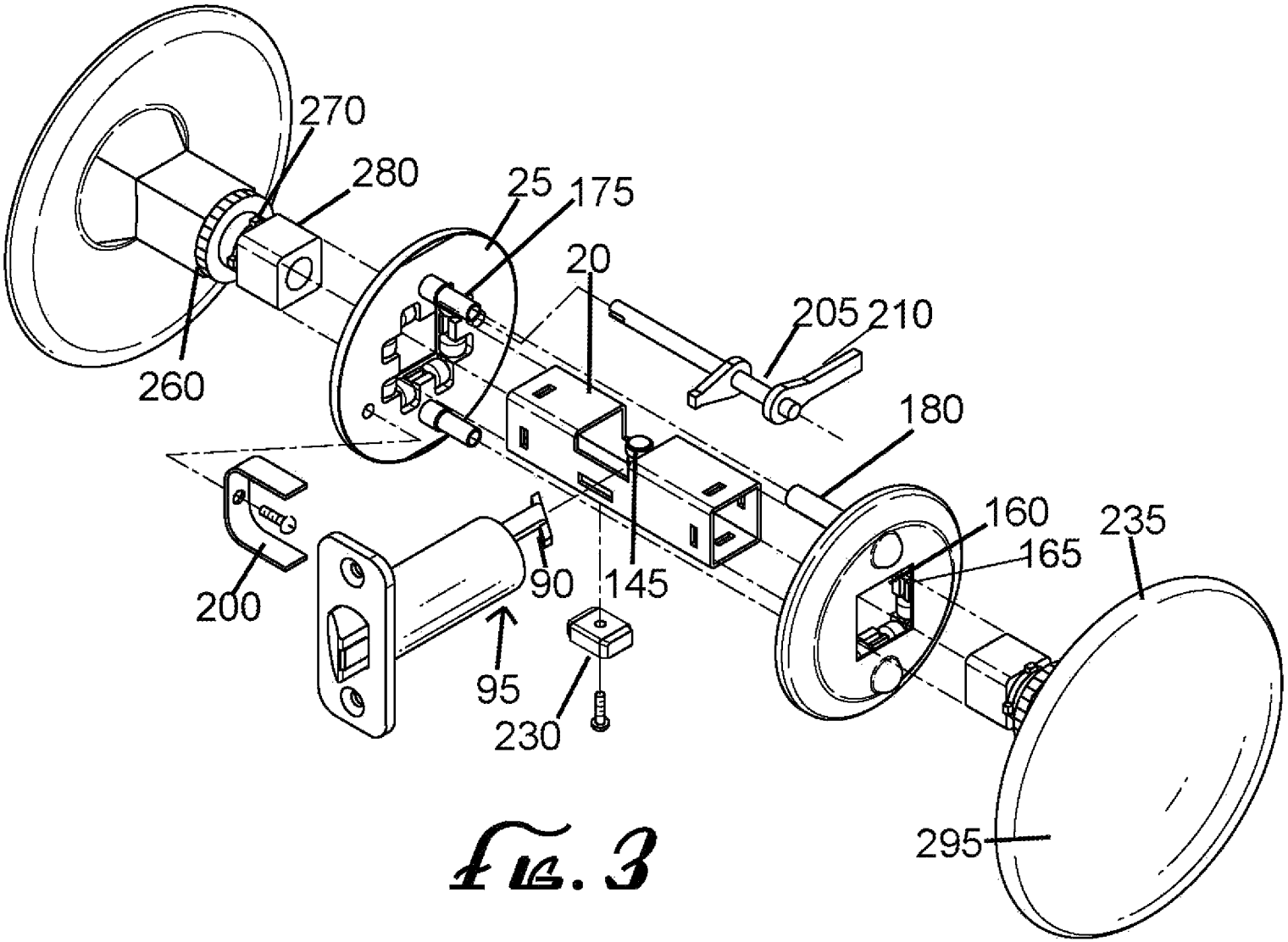
FIG. 3 shows an exploded view of the apparatus of FIG. 1.
Figure 4:
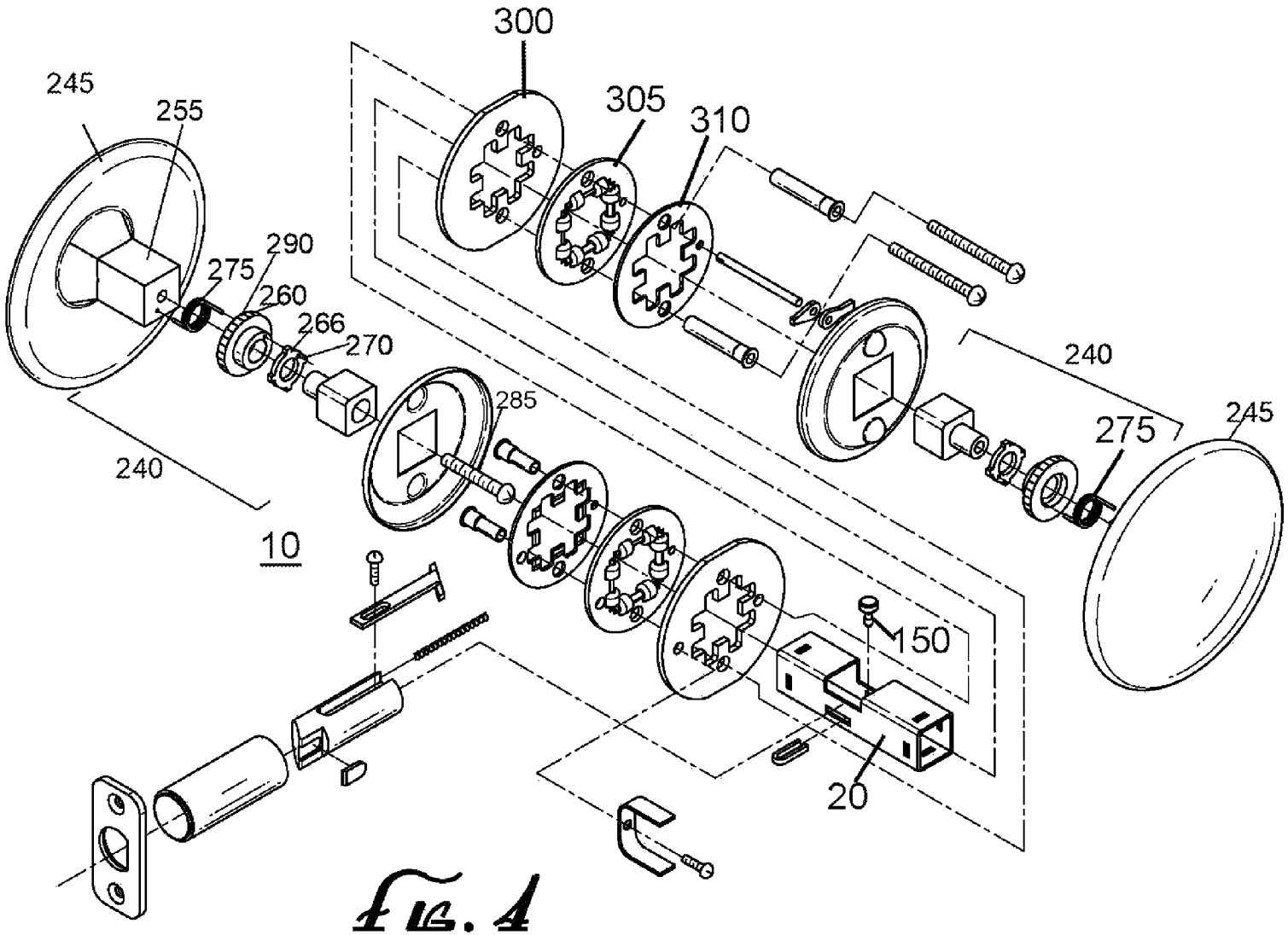
FIG. 4 shows another exploded view of the apparatus of FIG. 1.

In another preferred embodiment of the actuator is shown in FIGS. 2-4, there is a generally elongated structure with the same number of sides to engage the inside opening of the actuator support; as shown in FIG. 2-4, there are four outer sides, and at least one inner side; there are two ends to the actuator with several notches or holes (to engage the door handle). The actuator is not limited to a certain number of sides or edge surfaces, but the actuator should be able to engage the actuator support.

Generally, within the center of the actuator, there is at least one axle and bushing within an opening within the central cavity of the actuator. The axle is mounted to the actuator using a simple strap or weld or strip of material to hold the axle in place. See FIGS. 3, 13 and 14.

On another portion of the outer surface of the actuator, there is a feature or raised portion that acts to restrict the range of motion of the actuator when the user pushes the door handle or pulls the door handle. This feature can also have padded, rubber or damping materials.

In the most simple version of the actuator, instead of a bushing, there can be a rolling or sliding surface to engage the AES on the bolt.

Actuator Support

There is at least one actuator support 25, and the preferred embodiment uses two actuator supports. Each support has a body, which has a generally central opening 160. The actuator has a shape, and the generally central opening of the actuator support has a corresponding shape that provides the necessary support to the actuator.

In the preferred embodiment, each opening 165 is surrounded by four orthogonal sides that each have multiple bushings (roller bearings) 172 and bushing axles (roller bearing pins) 170. Preferably, there are two bushing rollers (roller bearings) on each side of the opening that allows for improved load balance, and using two bushings allows for compensation for any potential rotation of the actuator. Accompanying axles or roller pins are associated with each roller or bushing.

These bushing rollers can also be placed at the edges of each corner (of the inside of the actuator) so that the point of contact with the actuator is optimally placed in the center of the bushing to reduce any friction of the apparatus. The location of the bushings at ninety degrees from the adjacent side should also be close together to have a continuous and smooth function. The bushings are mounted on a bushing axle for each side of the opening.

The actuator supports also have screw holes or features 175; there are also screw guides 180 for attaching screws from the first actuator support to the second actuator support. The actuator is supported by two actuator supports with bushings and bushing axles; the bushing or rolling surfaces within the actuator supports allow the actuator to move freely within the actuator supports and to support a large moment without any kind of binding. This advantage allows for this apparatus to use any kind of size or shape for the door handles.

Even though other shapes for the cross-section of the actuator and actuator opening can be used, it is preferred to use a square central cross-sectional shape for the actuator and actuator support opening for easier manufacturing and the reduction of any friction or binding; the bushings are currently made of nylon or nylon composites, but bronze or other fireproof materials can be used.

In the most simple version of the actuator, instead of a bushing, there can be a rolling or sliding surface to engage the AES on the bolt. And, instead of using bearings and bearing pins, there can be simple sliding surfaces on the inside of the actuator support that freely engage the actuator; these sliding surfaces can be made of materials like plastics or other similarly low friction materials.

The actuator sliding surface can be a bearing or a bushing, which is mounted on a bearing axle or a bushing axle; each actuator support structure has a central opening, which accommodates the actuator; on an edge of the opening of each actuator support structures, there is at least two roller bearings and at least two roller bearing pins; said actuator support structures has a base section, a midlevel section and a cover section; the base section has a matching number of grooves for the at least two roller bearing pins and a base section opening; the midlevel section provides an elevation space to allow the roller bearings to rotate freely about the roller bearing pins; the cover section keeps the base section, the midlevel section, the roller bearings and roller bearing pins to be contained and with a proper alignment and orientation with respect to the actuator; whereby when the force is applied to the first actuator end; said actuator support structures allow the actuator to move freely within said actuator supports and provides a uniform support around said actuator ends.

In one preferred embodiment as shown in FIG. 4 and FIG. 9-12 and FIG. 15-17, the actuator support has three separate components:

1. Base or foundation 300 can have grooves for the axles and a generally central opening; the central opening has cut outs and edges to correspond with the midpiece and top section of the actuator support.
2. Midpiece or midlevel section 305 of the actuator support further provides elevation or height space to allow the bushings to rotate freely about the axles; the midlevel piece also provides lateral support of the axles.
3. Cover level 310 is to keep the entire actuator support assembly, including the bushings and axles to be contained and with the proper alignment and orientation; the cover can also have ridges or grooves 320 to further hold the axles or roller pins in place.

As shown in FIGS. 9-10 and 15-17, each level (base, midlevel and the cover) of the actuator support has a central opening to accommodate the actuator (outer shape) and the corresponding bushing and bushing axles. As noted above to maximize stability laterally and axially and to provide enough freedom to allow the bushings to rotate and provide a free and unrestricted movement (of the actuator within the actuator support), each level of the actuator support can be made to focus on a particular function and to have a particular opening and shape and corners to maximize each level's function.

For example, the base or foundation level has both cut outs or openings to allow free rolling of the bearings around the axles or pins; but, the base level and cover level also can have grooves to hold the pins in place; the middle or midlevel section of the actuator support provides a elevation or height, but the middle section's openings are a bit more complicated in its inner edges to not only keep the bushings in proper alignment, but also to keep the axles or pins in proper alignment. See Parts No. 325 (base level corners); 330 (middle level corners); 335 (cover level corners). In particular, in the middle level corners, there is an additional corner (Part No. 330); these cutouts and openings create these corners.

Note that axial is defined along the axis of the actuator. The three components of the actuator support are held together with some sort of attachment means including a screw, bolt or weld.

One can have multiple elevation pieces for the actuator support. The above preferred embodiment is one possible iteration and not intended to be limiting; the axles can be confined within the channels or grooves of the base or foundation piece of the actuator support; and the bushing can have enough clearance to have freedom to roll, but also at the same keeping both the bushings and axles in proper alignment and to not allow unwanted lateral or axial movement.

The Actuator Support (internal or inside) provides a surface that interfaces with the door face (inside); other features include: a. guides and supports the Actuator perpendicular to the door face and on the inside of the door; b. supports, via a low friction interface the actuator on the inside of the door; c.

provides and positions the Actuator Support Axles; d. provides a guide and positions the Actuator Support Bushings that rotate about the Actuator Support Axles; e. provides a recess on the interior surface for locating the Bolt Housing Alignment Guide, which positions the actuator supports relative to the both housing to ensure that the only contact between the Actuator and Bolt is through the actuator bushing and the curved surface or AES part of the bolt; f. provides positioning of mounting screws that hold the Inside and Outside Actuator Supports; g. provides a guide and locates the outside Actuator Support relative to the inside Actuator Support; and h. provides a guide and support for the privacy lock shaft.

The Actuator Support (external or outside) also provides a surface that interfaces with the door face (outside); other features are: a. guides and supports the Actuator perpendicular to the door face and on the outside of the door; b. supports, via a low friction interface the actuator on the outside of the door; c. provides and positions the Actuator Support Axles; d. provides a guide and positions the Actuator Support Bushings that rotate about the Actuator Support Axles; e. provides threads for the screws that hold the outside and inside Actuator Supports; f. provides a guide and locates the outside Actuator Support relative to the inside Actuator Support; and g. provides a guide and support for the privacy lock shaft.

Guides for Screws in Actuator Support:

The pair of actuator support structures have at least one guide tube or hollow guide structure for connecting said pair of actuator supports to one another with a screw, a bolt or a threaded pin. In FIG. 4, the pair of actuator support structures have at least one guide tube for connecting said pair of actuator supports to one another with a screw, a bolt or a threaded pin. Further, one of the guide tubes can be threaded; one of the guide tubes can fit within the corresponding guide tube on the other actuator support side in an overlapping arrangement.

U-Shaped Bolt Guide on the Inner Surface of the Actuator Support

On one inner surface of the actuator support, there can be a U-shaped support or guide 200 to help position the bolt relative to the actuator (see FIG. 4). This U-shaped support helps reduce friction by guiding the bolt so that contact is focused between the AES and the roller or bushing on the actuator. The U-shape is not intended to be limiting, and other shapes or dimensions can be used to guide the bolt and bolt housing.

In addition, there can be a cover or escutcheon for the actuator support apparatus. The strike plate is mounted in the door frame, and one embodiment will have at least one bushing and bushing axle to engage the flat surface on the bolt. Other embodiments do not require a bushing and bushing axle but instead, employ opposing pads made of a low friction plastic, teflon coated or other similar materials.

An adapter can be used to attach the door handles to the terminal ends of the actuator, which allows for attachment of basically anything to act as door handle, such as cartoon character face, a piece of wood, a baseball, custom door handle for the handicapped or an emergency bar. Another version allows for a push button release to detach a lighted door handle in emergencies or a remote control or motor operated opener within the door latch apparatus. In another version, within each end of the actuator, there is at least one hole that has a spring loaded pin that engages at least one grooved pin on the door handle engagement end.

Figure 6A:
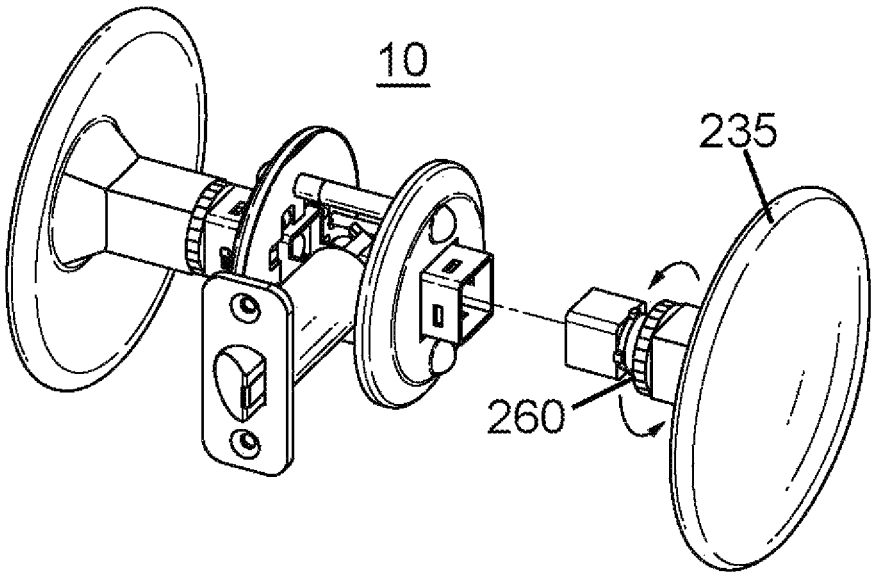
FIGS. 6A and 6B show how the door handle is attached to the actuator assembly.
Figure 6B:
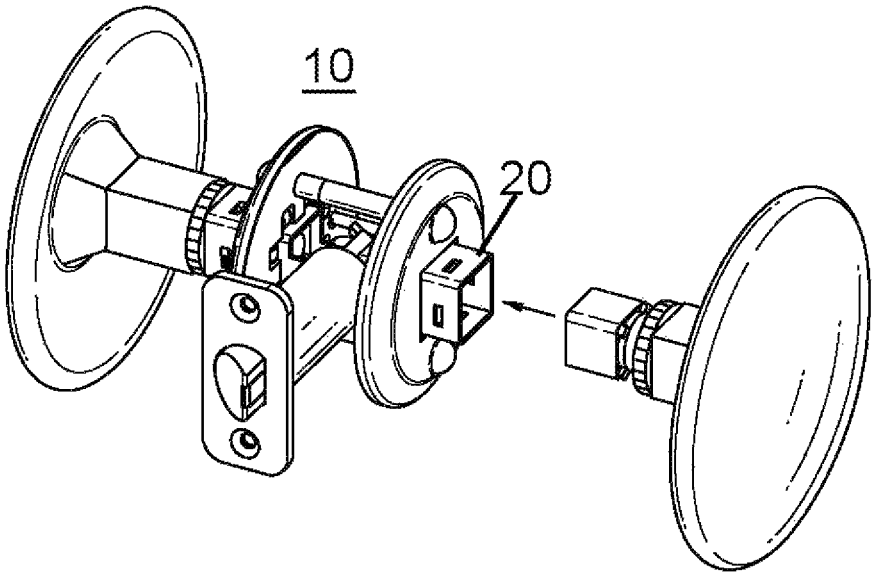
Figure 7:
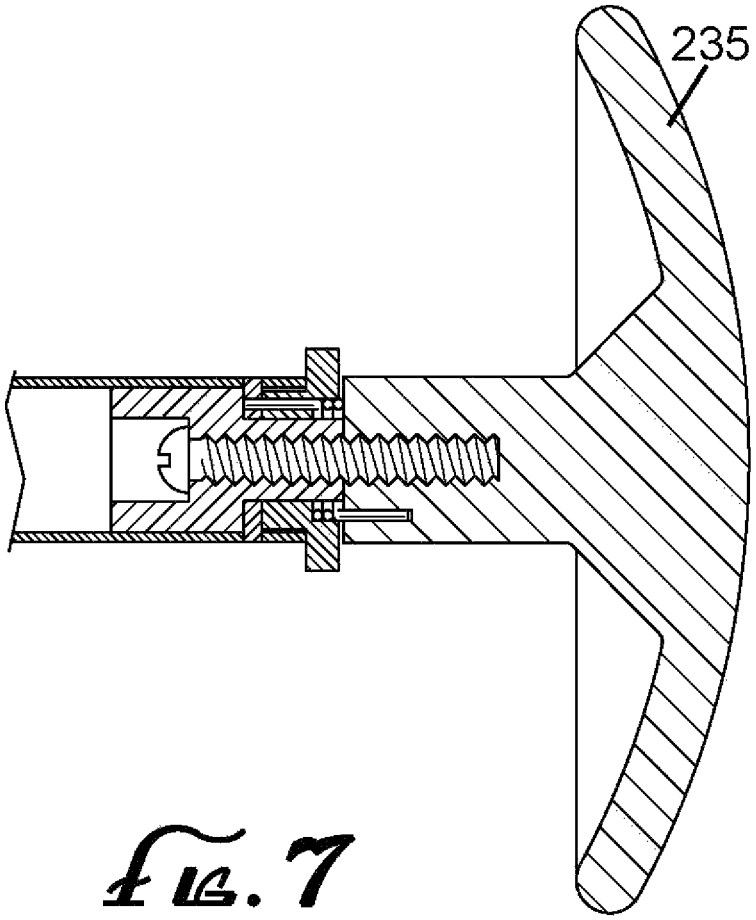
FIG. 7 is a cross section view of the door handle along sight lines 7-7 in FIG. 2A.
Figure 8A:
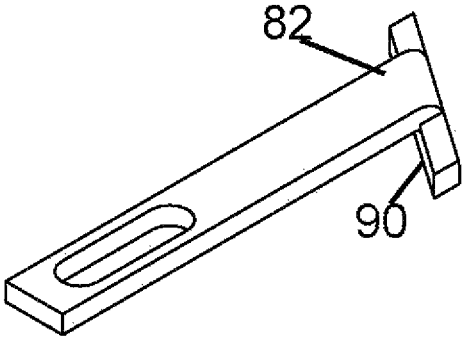
FIG. 8A is a perspective view of the bolt with the actuator engagement area (AES).
Figure 8B:
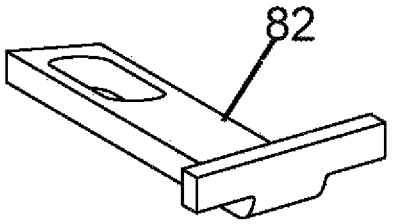
FIG. 8B is a perspective view of another embodiment of the bolt.
Figure 9:
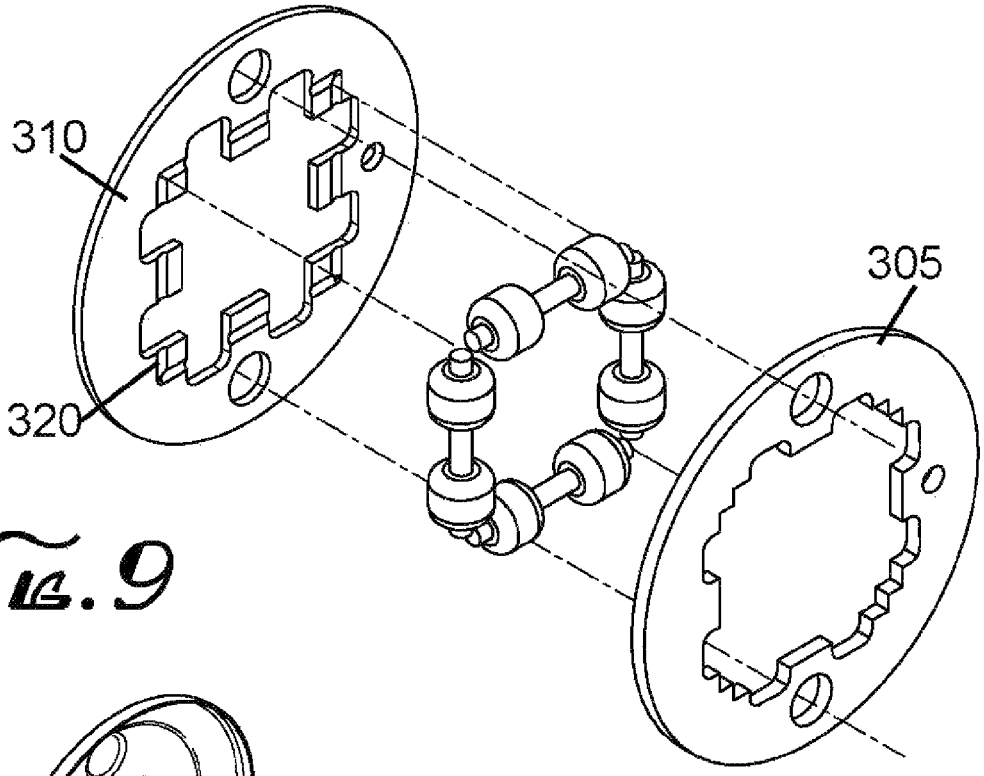
FIGS. 9 and 10 are exploded views of the actuator support.
Figure 10:
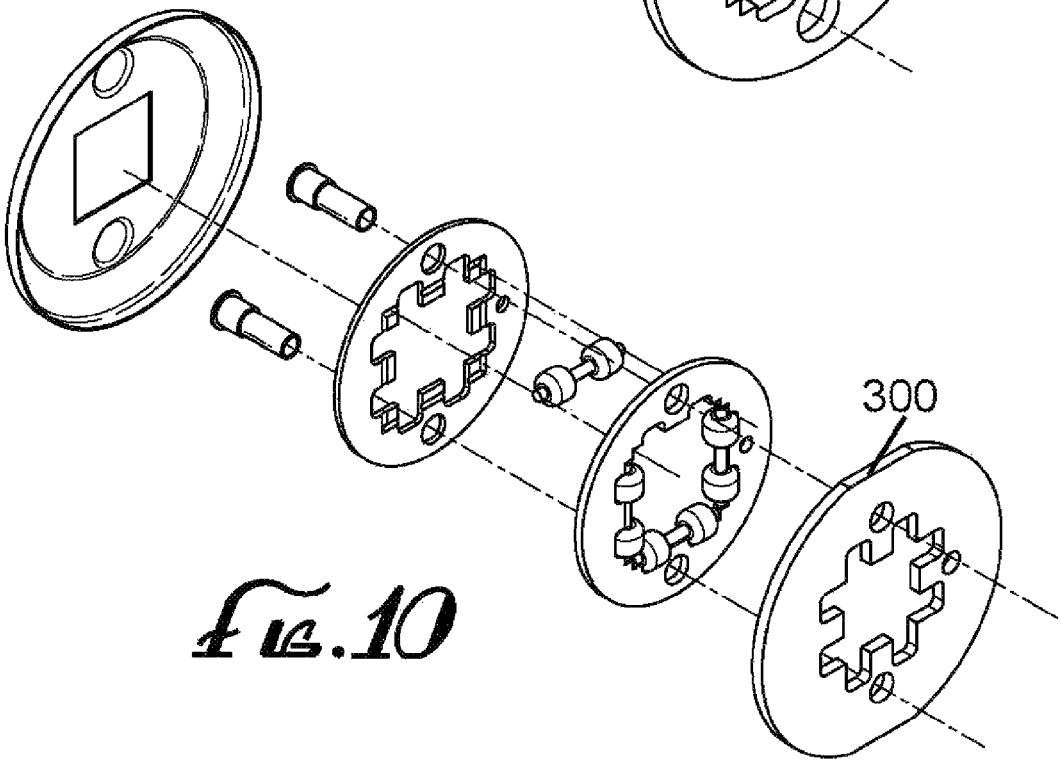

Handles:

In FIGS. 4, 6 and 7, the preferred embodiment has a handle 235 with a first handle end (handle itself) 245 and the second handle end (engagement area to connect to the inside of the actuator) 250. This second handle end has a release ring 260, a locking ring 266 with teeth or tabs 270, at least one spring 275 and the mounting piece 280. The release ring, locking ring, at least one spring and the mounting piece are all connected to the handle with a screw or bolt 285. The release ring can have ridges or a knurled surface for easy gripping for hand use.

The spring provides enough resistance force to allow the locking ring to rotate from an unlocked or first position to a locked or second position; the teeth of the locking ring align with slots or opening on the ends of the actuator.

The teeth of the locking ring will engage matching slots on the ends of the actuator; to release the door handle, the user will rotate the release ring so that the locking ring will rotate against the at least one door handle spring, and the teeth of the locking ring will be able to disengage the matching slots on the actuator ends and the door handle will be able to be detached from the actuator.

This new embodiment for attaching handles allows for one hand removal and installation of a door handle; this allows for simple and easy customization and decoration for a user. For example, the home owner could change a handle depending on the season. The handles can have its own electronics 295, lighting and sound production, motion sensor and a camera and wireless link.

In addition to regular sized handles, wide handles mount in a rather unique way. The pins are mounted in a block, which is mounted to the handle via a mono-ball, so that the position of the handle is fixed in only two dimensions that are in plane of the door face. The other end uses a pin that is vertical and parallel to the door face, so it constrains the handle out of plane and prevents that handle from tipping forward or backward. The hole for the handle side of the pin engagement is slotted parallel to the door face and provides freedom so that if the handle and door expand or contract at different rates (as a result of temperature or humidity), then it will not cause any binding or place any lateral load on the mounts. The pivot point is for the mono-ball, which is sometimes referred to as a Spherical Plain Bearing.

Privacy Lock:

As shown in FIG. 3-4, this invention also allows for a rotatable privacy lock 205 that engages one surface of the actuator. One of said actuator supports has a rotatable arm 210 with a first arm end and a second arm end; the first arm end can engage a hole on said actuator in a first locked position; said rotatable arm is swung from a first locked position to a second unlocked position, wherein said first arm end is free from the hole on the actuator. The privacy lock has an end that is accessible from the outside of the locking apparatus so the lock can be disengaged with a screwdriver or an Allen wrench.

Electronics:

This invention also allows for supplemental electronics 295 to indicate whether the privacy lock is engaged or the movement of the door (including differentiating between normal opening/closing vs. erratic earthquake movement). LAN (local area connection, wired or wireless) connections can also be included to be used with a wireless home/office security system. These electronics would have an appropriate power source such as battery or other hard wired electrical connections. These examples are improvements to not only this apparatus for a door handle, but can be applied existing door handle assemblies.

Emergency Lighting, Sensing Earthquake:

The accelerometer senses motion in three orthogonal axes that are perpendicular to one another and digitizes the analog motion that is sensed.

The signals are transmitted to the micro-processor. The micro-processor uses a set of definable and programmable parameters to distinguish the normal door operation and the motions of an earthquake. The parameters can be frequency, change in direction of the motion and the duration or successive motions. If the micro-processor determines that the signals for the accelerometer indicate that an earthquake is occurring, it will turn on the light or light emitting diode (LED) and keep the light on for a predetermined amount of time following the end of the earthquake or seismic shaking.

Lock Engaged Lighting:

There are two preferred methods of sensing that the privacy lock is engaged or active. The first method employs a "Hall Effect" sensor located in proximity to a section or part of the privacy lock shaft. Within this section, there is a permanent magnet, which is attached to the shaft.

When the lock is disengaged or inactive, the privacy lock shaft and permanent magnet are in a particular relationship with the Hall Effect sensor. When the user engages the privacy lock by rotating the privacy lock shaft, the position of the permanent magnet changes position with respect to the Hall Effect sensor. The Hall Effect sensor detects the change in the magnetic field and sends a signal to the micro-processor. When the micro-processor receives this signal, it turns on the LED (either continuously or periodically) on the outside of the door to indicate that the lock is engaged or active.

When the user disengages the privacy lock shaft, the magnet, which is attached to the privacy lock shaft, returns to its disengaged position, and the magnet, which is attached to the privacy lock shaft, returns to it default position relative to the Hall Effect Sensor. The Hall Effect sensor sends a signal to the micro-processor. The micro-processor then turns off the LED. Other methods or systems for sensing the engagement or disengagement of the privacy lock can be employed, including without limitation, a simple rotating color or message like in an airplane lavatory.

Computing System Elements:

The embodiments of the invention may be integrated with or implemented by a processor-based computer system. The system includes a database for receiving and storing information from users and application software for users. A computer system operates to execute the functionality for server component. Computer system includes a processor, a memory and a disk storage. Memory stores computer program instructions and data. Processor executes the program instructions or software, and processes the data stored in memory. Disk storage stores data to be transferred to and from memory. Note that disk storage can be used to store data that is typically stored in the database.

All these elements are interconnected by one or more buses, which allow data to be intercommunicated between the elements. Note that memory is accessible by processor over a bus and includes an operating system, a program partition and a data partition. The program partition stores and allows execution by processor of program instructions that implement the functions of each respective system described herein. The data partition is accessible by processor and stores data used during the execution of program instructions.

For purposes of this application, memory and disk are machine readable mediums and could include any medium capable of storing instructions adapted to be executed by a processor. Some examples of such media include, but are not limited to, read-only memory (ROM), random-access memory (RAM), programmable ROM, erasable programmable ROM, electronically erasable programmable ROM, dynamic RAM, magnetic disk (e.g., floppy disk and hard drive), optical disk (e.g., CD-ROM), optical fiber, electrical signals, light wave signals, radio-frequency (RF) signals and any other device or signal that can store digital information. In one embodiment, the instructions are stored on the medium in a compressed and/or encrypted format. As used herein, the phrase "adapted to be executed by a processor" is meant to encompass instructions stored in a compressed and/or encrypted format, as well as instructions that have to be compiled or installed by an installer before being executed by the processor. Further, system may contain various combinations of machine readable storage devices, which are accessible by processor and which are capable of storing a combination of computer program instructions and data.

A computer system also includes a network interface. Network interface may be any suitable means for controlling communication signals between network devices using a desired set of communications protocols, services and operating procedures. Communication protocols are layered, which is also referred to as a protocol stack, as represented by operating system, a CBE-communication layer, and a Transport Control Protocol/Internet Protocol (TCP/IP) layer. Network interface may also include connectors for connecting interface with a suitable communications medium. Those skilled in the art will understand that network interface may receive communication signals over any suitable medium such as twisted-pair wire, co-axial cable, fiber optics, radio-frequencies, and so forth.

A typical computer system includes a processor, a memory, disk storage, a network interface, and a protocol stack having a CBE-communication layer and a TCP/IP layer. These elements operate in a manner similar to the corresponding elements for computer system.

Materials:

Without being limiting, most components are made of aluminum or cast aluminum or another suitable alloy; the bushings can be made of bronze or other fire-proof or fire-safe materials or Oilite brand material.

Other Improvements: Actuator Stop with Integrated Damper

This invention also provides the following improvement structures to a door handle apparatus, including without limitation: Actuator Support Bearings; Actuator Support Bearing Axles; Alignment Guide "U" shaped thing that ensures that only the roller bushing on the actuator is the only point of contact; Spring Force Compensation Curved Surface; Actuator Stop with Integrated Damper; Actuator Support Alignment Guide (this is the one that registers on the Bolt Housing); and a Cap to fit over stop for thicker doors.

Figure 11:
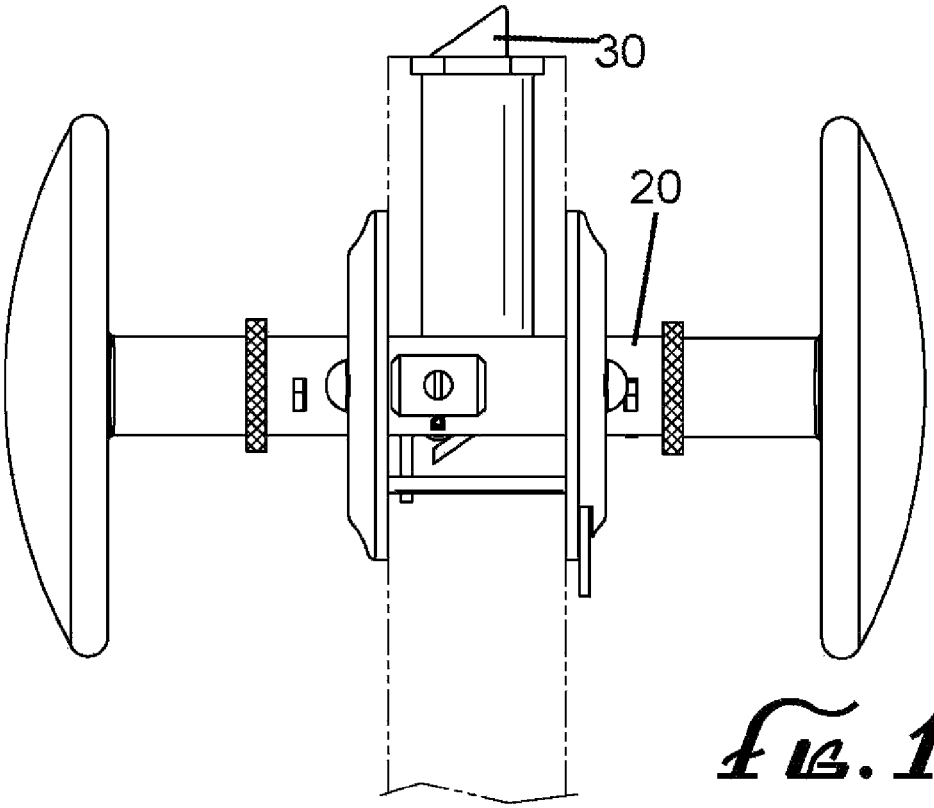
FIG. 11 shows a side view of the apparatus.
Figure 12:
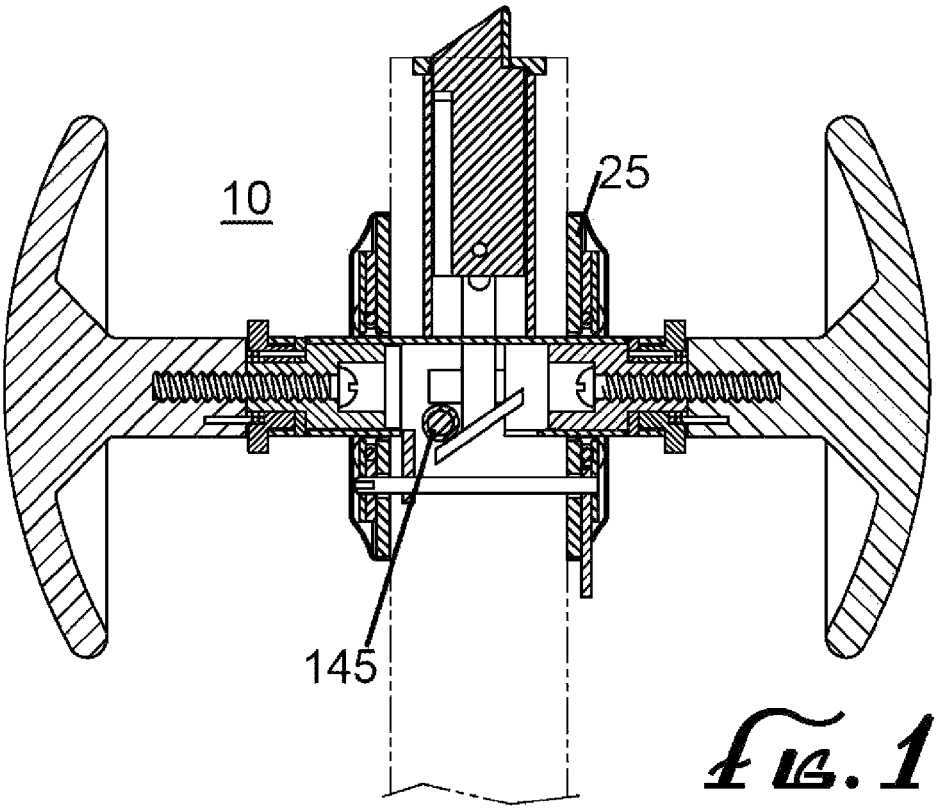
FIG. 12 shows a cross sectional view of the apparatus.
Figure 13:
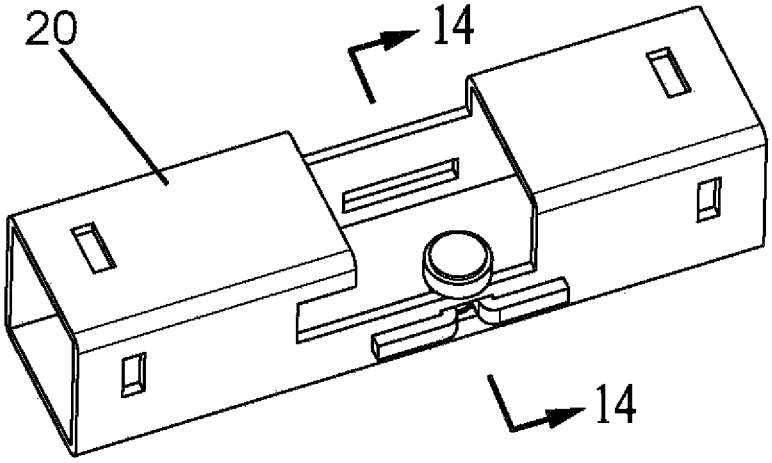
FIG. 13 shows a perspective view of the actuator.
Figure 14:
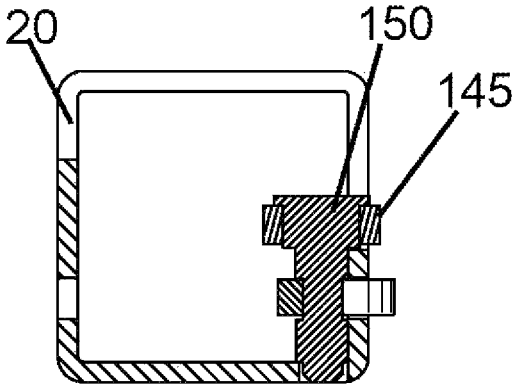
FIG. 14 shows a cross-sectional view of the actuator along the sight lines in FIG. 13.
Figure 15:
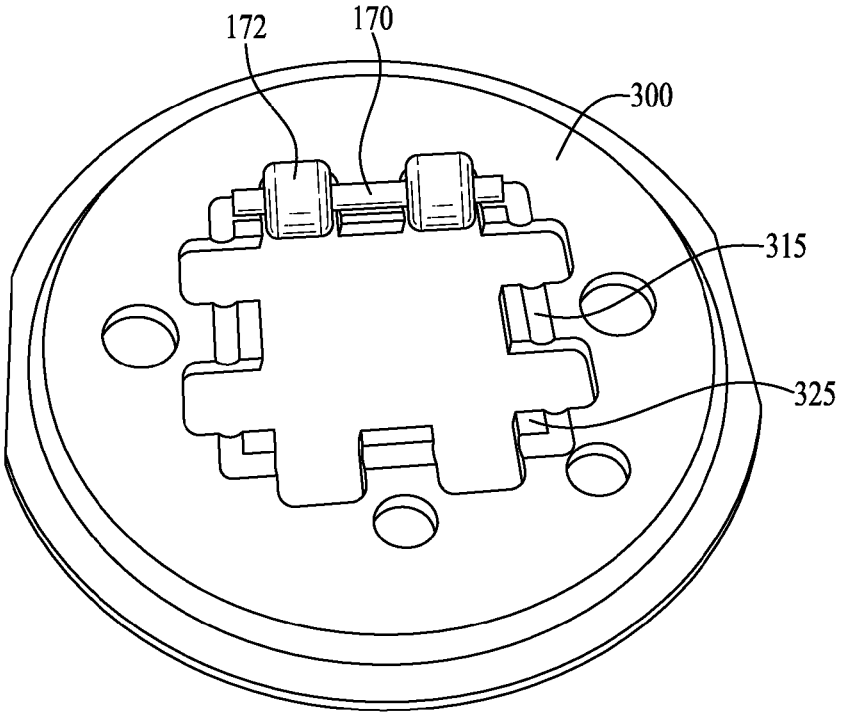
FIGS. 15, 16 and 17 show each section (base, middle and cover) of the actuator support being added one layer at a time and the placement of bushings and axles on one side of the inner portion of the actuator support.
Figure 16:
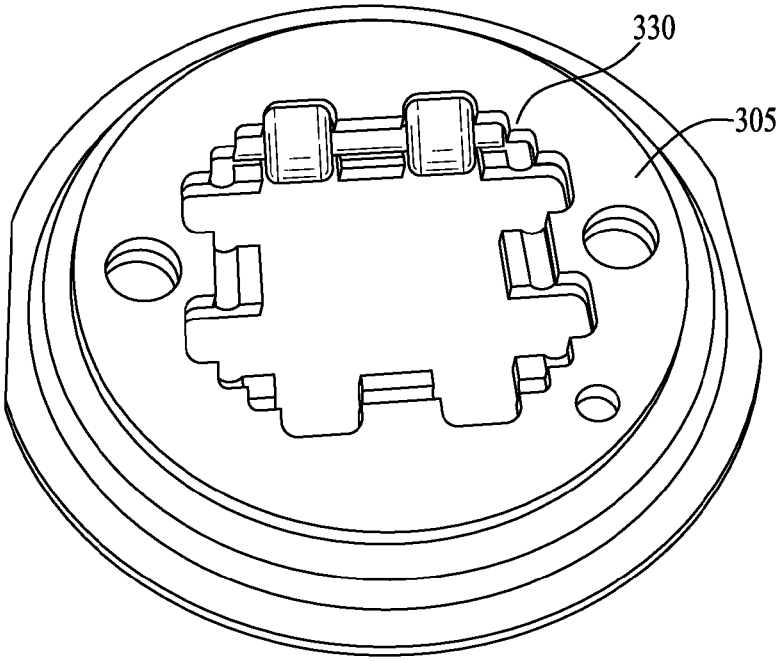
Figure 17:
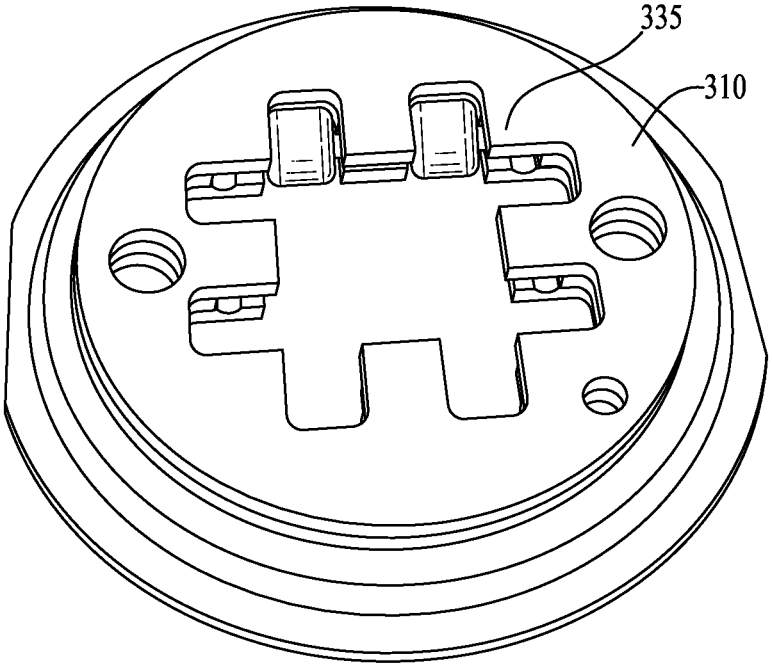

As shown in FIGS. 3 and 11, there is a detachable or removable stop, bumper or protuberance extending from the side of the actuator that engages the actuator support; this bumper restricts the range of travel of the actuator along one axis length. This bumper or stop will transfer forces that are beyond the range of travel of the actuator to the actuator support and ultimately create a tensile force on the screws that clamp the two actuator supports to either side of the door. This eliminates the additional moment placed on the bolt, which must act like a stop for the actuator, and it is internal so there are no pinch points that could cause injury to the user.

Identical features in each end of the actuator to provide a quick-release attachment for door handles; this quick-release mechanism can employ ball locks with the inside of the ball lock is slightly angled (1 to 2 degrees) to allow for manufacturing tolerances. There can be a reduction of size and change in shape of the actuator supports for aesthetic purposes.

In another improvement, the actuators can have a tumbler lock and key on the actuator ends, which can engage the inside of the actuator supports; this is similar to a privacy lock.

In another improvement, there can be alignment guides on the actuator support (preferably flat or rectangular) that engage and align with the outside of the bolt housing. Two guides (top and bottom) will extend from the inside of the first actuator support and extend and engage to the bolt housing.

In existing inventions, the bushing between the actuator and bolt present a low friction or anti-friction line contact bearing surface that is intended to carry loads that come from one specific direction, which are perpendicular to the inclined surface.

The bushing in my design differs in two significant ways: (1) bearings in the actuator support; and (2) actuator supports and bushings acting in tandem.

1. Bearing in One Actuator Support:

Because the bushings are orthogonal to one another, they can carry lateral loads from any direction within a plane that is established by the contact lines of the bushing. But, when a force that is not coincident with the axis of the actuator, it creates a contact with the bearing surfaces and produces lateral loads. This is best illustrated by imaging that if there were only one actuator support and if you pull down on the handle on the outside of the actuator support, then an upward force is created on the opposite side of the actuator support.

2. Both Actuator Supports and Bushings Acting in Tandem:

With the bushings (placed at the orthogonal sides and at the edges of the opening on the actuator support) acting in tandem, or the two planes of contact with two anti-friction load bearing surfaces on either side. This is not the case with the other designs. First, the load bearing surfaces are not anti-friction, and they do not comprise a line contact established by a plane. Instead, their support comes through the multiple contact of many planes. For example, in applying a similar downward force to the handle to the types of bearing surfaces in the other designs and where there has to be some clearance between the sliding surfaces, instead of the load being carried by the entire plane or planes (depending upon the direction force), the front edge of the plane becomes the bearing surface. As a result, an almost infinitely small area is carrying the entire load, which explains why the operation of the handle of prior art devices go from bad to worse in an instant and cause unnecessary friction and tie up of the system.

In this invention, I am not only providing an anti-friction bearing surface, but I am also controlling exactly where the loads are carried.

General Disadvantages with Current Push-Pull Door Mechanisms

Existing Push-Pull door mechanisms typically require a separate device such as mount with paddles to actuate the mechanism. These paddles can only be oriented in one specific direction at a time, forcing the user to position their hand to match the orientation of the paddle or handle to open the door.

In all spring loaded push-pull designs, the act of pushing or pulling to release the door causes friction between the sliding surfaces. As the mechanism is actuated, the spring force increases which in turn increases friction within the mechanism and bolt and strike plate, so that the user has to apply continually increasing force, until the bolt releases from the strike plate.

Current designs are complex mechanisms that take more force to operate due to the number of sliding surfaces and the additional pivot located within the separate paddle/handle mechanism.

As specified in the prior art, the mechanism starts off with a mechanical disadvantage meaning more force is spent pushing on the door which increases friction between the bolt and strike plate then is spent drawing the bolt back to release the door. In prior art design, forces that are exerted by the user beyond the limit of travel of the mechanism create a moment on bolt, which is then transferred to any bolt housing, and then the screws that mount the bolt housing to the door.

Advantages of My Improvements:

The shape of the actuator and corresponding shape of the bearing network are designed to accommodate moments that can be generated by cantilever handles that extend perpendicularly and well beyond the actuator without any significant increase in friction. This allows the design of handles for convenience that do not force the user to position their hand in any specific attitude to operate the mechanism.

The improved mechanism greatly reduces friction and improves easy of operation by reducing the number of number of moving parts and sliding surfaces (only one) that are apparent or implied in existing designs.

The mechanism starts off with an equal mechanical advantage and because the inclined surface of the actuator is curved so that mechanical advantage is maintained as spring force increases. The actuator engages the inclined surface of the bolt via a roller bushing eliminating a sliding surface.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Further, the headings, section dividers, terms and phrases used herein are not intended to be limiting; but rather, to provide organization and an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly, and not necessarily mechanically.

Any element in a claim that does not explicitly state "means for" performing a specific function, or "step for" performing a specific function, is not be interpreted as a "means" or "step" clause as specified in 35 U.S.C. Sec. 112, Paragraph 6. In particular, the use of "step of" in the claims herein is not intended to invoke the provisions of 35 U.S.C. Sec. 112, Paragraph 6.

The invention claimed is:

1. An apparatus for a handle for a door and a door frame and a strike plate on said door frame comprising:

a bolt assembly having a bolt and a spring;

said spring with a first spring end and a second spring end;

the first spring end engages the bolt;

the second spring end is connected to a bolt housing;

said spring applies a resistant force against said bolt;

the bolt having a first bolt end and a second bolt end;

the first bolt end being able to engage the strike plate so that the apparatus engages the door and so that the door is closed;

the second bolt end having an angled engagement surface;

an actuator has a first actuator end and a second actuator end;

an actuator bushing and a bushing axle lies between said first and the second actuator ends;

the actuator is oriented to said bolt so that the actuator bushing is able to roll along the angled engagement surface of the bolt, such that when a force is applied to the first actuator end, said actuator bushing is able to translate said force along the angled engagement surface and move the bolt from a first position to a second position, which disengages the first bolt end from the strike plate and the door can be opened, a pair of actuator support structures surround the first and second actuator ends;

each actuator support structure has a central opening, which accommodates the actuator;

on an edge of the opening of each actuator support structures, there is at least one roller bearing and at least one roller bearing pin;

said actuator support structures has a base section, a midlevel section and a cover section;

the base section has a matching number of grooves for the at least one roller bearing pin and a base section opening;

the midlevel section provides an elevation space to allow the at least one roller bearing to rotate freely about the at least one roller bearing pin;

the cover section keeps the base section, the midlevel section, the at least one roller bearing and the at least one roller bearing axle to be contained and with a proper alignment and orientation with respect to the actuator;

whereby when the force is applied to the first actuator end; said actuator support structures allow the actuator to move freely within said actuator supports and provides a uniform support around said actuator ends.

2. The apparatus of claim 1 wherein said pair of actuator support structures have at least one guide tube for connecting said pair of actuator supports to one another with a screw, a bolt or a threaded pin.

3. The apparatus of claim 1 wherein one of said actuator supports has an alignment guide structure for holding said bolt.

4. The apparatus of claim 1 wherein one of said actuator supports has a rotatable arm with a first arm end and a second arm end;

the first arm end can engage a hole on said actuator in a first locked position;

said rotatable arm is swung from a first locked position to a second unlocked position, wherein in the second unlocked position, said first arm end is free from the hole on the actuator and said actuator can move against said bolt.

5. The apparatus of claim 1 wherein the actuator has a stop structure, which restricts the range of travel of the actuator along one axis length.

6. The apparatus of claim 1 wherein the actuator bushing and bushing axle is an actuator sliding surface.

7. The apparatus of claim 1, further comprising a motion sensor, a light, a battery, a computing device, a wireless communication connection or a speaker.

8. An apparatus for a handle for a door and a door frame and a strike plate on said door frame comprising:

a bolt assembly having a bolt within a bolt housing;

said bolt having a spring with a first spring end and a second spring end;

the first spring end engages the bolt;

the second spring end is connected to the bolt housing;

the bolt can move within the bolt housing and said spring applies a resistant force against said bolt;

the bolt having a first bolt end and a second bolt end;

the first bolt end being able to engage the strike plate so that the apparatus engages the door and so that the door is closed;

the second bolt end having a curved engagement surface;

an actuator is placed perpendicularly to said bolt;

the actuator has a first actuator end and a second actuator end;

an actuator sliding surface lies between the first and the second actuator ends;

said actuator sliding surface being able to move along the curved engagement surface of the bolt, such that when a force is applied to the first actuator end, an actuator bushing is able to translate said force along the curved engagement surface and move the bolt from a first position to a second position, which disengages the first bolt end from the strike plate and the door can be opened, a pair of actuator support structures surround the first and second actuator ends;

each actuator support structure has a central opening, which accommodates the actuator;

wherein on an edge of the opening of each actuator support structures, there is at least one roller bearing and at least one roller bearing axle;

said actuator support structures has a base section, a midlevel section and a cover section;

the base section has a matching number of grooves for the at least one roller bearing axle and a base section opening;

the midlevel section provides an elevation space to allow the at least one roller bearing to rotate freely about the at least one roller bearing axle;

the cover section keeps the base section, the midlevel section, the at least one roller bearing and the at least one roller bearing axle to be contained and with a proper alignment and orientation with respect to the actuator;

whereby when a pushing force is applied to the first actuator end; said actuator support structures allow the actuator to move freely within said actuator supports and provides a uniform support around said actuator ends.

9. The apparatus of claim 8 wherein the actuator sliding surface is a bearing or a bushing, which is mounted on a bearing axle or a bushing axle.

10. The apparatus of claim 8 wherein said pair of actuator support structures have at least one guide structure for connecting said pair of actuator supports to one another with a screw, a bolt or a threaded pin.

11. The apparatus of claim 8 wherein one of said actuator supports has an alignment guide structure for holding said bolt.

12. The apparatus of claim 8 wherein one of said actuator supports has a rotatable arm with a first arm end and a second arm end;

the first arm end can engage a hole on said actuator in a first locked position;

said rotatable arm is swung from a first locked position to a second unlocked position, wherein in the second unlocked position, said first arm end is free from the hole on the actuator and said actuator can move against said bolt.

13. An apparatus for a handle for a door and a door frame and a strike plate on said door frame comprising:

a bolt assembly having a bolt and a spring;

said spring with a first spring end and a second spring end;

the first spring end engages the bolt;

the second spring end is connected to a bolt housing; said spring applies a resistant force against said bolt;

the bolt having a first bolt end and a second bolt end;

the first bolt end being able to engage the strike plate so that the apparatus engages the door and so that the door is closed;

the second bolt end having an angled engagement surface;

an actuator has a first actuator end and a second actuator end;

an actuator bushing and a bushing axle lies between said first and second actuator ends;

the actuator is oriented to said bolt so that the actuator bushing is able to roll along the angled engagement surface of the bolt, such that when a force is applied to the first actuator end, said actuator bushing is able to translate said force along the angled engagement surface and move the bolt from a first position to a second position, which disengages the first bolt end from the strike plate and the door can be opened, a pair of actuator support structures surround the first and the second actuator ends;

each actuator support structure has a central opening, which accommodates the actuator;

on an edge of the opening of each actuator support structures, there is at least two roller bearings and at least two roller bearing pins;

said actuator support structures has a base section, a midlevel section and a cover section;

the base section has a matching number of grooves for the at least two roller bearing pins and a base section opening;

the midlevel section provides an elevation space to allow the roller bearings to rotate freely about the roller bearing pins;

the cover section keeps the base section, the midlevel section, the roller bearings and roller bearing pins to be contained and with a proper alignment and orientation with respect to the actuator;

whereby when the force is applied to the first actuator end; said actuator support structures allow the actuator to move freely within said actuator supports and provides a uniform support around said actuator ends.

14. The apparatus of claim 13 wherein said pair of actuator support structures have at least one guide tube for connecting said pair of actuator supports to one another with a screw, a bolt or a threaded pin.

15. The apparatus of claim 13 wherein one of said actuator supports has an alignment guide structure for holding said bolt.

16. The apparatus of claim 13 wherein one of said actuator supports has a rotatable arm with a first arm end and a second arm end;

the first arm end can engage a hole on said actuator in a first locked position;

said rotatable arm is swung from a first locked position to a second unlocked position, wherein in the second unlocked position, said first arm end is free from the hole on the actuator and said actuator can move against said bolt.

* * * * *